United States Patent [19]

Oldroyd et al.

[11] 4,063,354

[45] Dec. 20, 1977

[54] SHAVING UNIT

[75] Inventors: Brian Oldroyd; Harry Pentney; John Charles Terry, all of Reading, England

[73] Assignee: The Gillette Company, Boston, Mass.

[21] Appl. No.: 690,874

[22] Filed: May 28, 1976

[30] Foreign Application Priority Data

May 29, 1975 United Kingdom ..... 23500/75

[51] Int. Cl.[2] ..... B26B 21/22

[52] U.S. Cl. ..... 30/47; 30/50

[58] Field of Search ..... 30/47, 50, 58, 62, 63, 30/77, 78, 79, 80, 286, 293

[56] References Cited

U.S. PATENT DOCUMENTS

| | | | |
|---|---|---|---|
| 2,327,967 | 8/1943 | Peters | 30/77 |
| 2,800,713 | 7/1957 | Roth | 30/47 X |
| 3,500,539 | 3/1970 | Muros | 30/63 X |
| 3,871,077 | 3/1975 | Nissen | 30/77 X |
| 3,955,277 | 5/1976 | Pomfret | 30/47 |

FOREIGN PATENT DOCUMENTS

| | | | |
|---|---|---|---|
| 2,444,292 | 3/1975 | Germany | 30/47 |
| 2,544,425 | 4/1976 | Germany | 30/77 |

*Primary Examiner*—Gary L. Smith

*Attorney, Agent, or Firm*—Richard A. Wise; Oistein J. Bratlie; Scott R. Foster

[57] ABSTRACT

A shaving unit having blade means exposed forwardly of an overlying cap member and rearwardly of a guard member, wherein the blade means and guard member are movable in unison and relative to the cap means against a resilient restoring force in response to forces transmitted to the unit during a shaving operation, to alter the shaving geometry of the unit.

3 Claims, 22 Drawing Figures

SHAVING UNIT

This invention relates to a shaving unit comprising a blade unit having its cutting edge (or edges) exposed forwardly of an overlying cap member and rearwardly of a guard member which, in use, engages the skin ahead of the blade unit.

Most men have areas on their faces in which hair grows at a greater density, or is coarser, than in others, and most shavers develop their own techniques for dealing with such areas and for adjusting for progressive dulling of blade edges, for example by stretching the skin locally, attacking areas from different directions, and exerting more or less direct pressure.

Various forms of adjustable razors have been marketed to enable users to vary the razor geometry, for example by altering blade exposure, but most users set the razor once and do not take account of progressive dulling by increasing blade exposure.

Razors have also been proposed in which a degree of automatic adjustment is provided, by permitting the blade unit to move against a spring bias to a position of reduced exposure, but such razors defeat the object of a user trying to obtain greater purchase in the tougher areas by application of greater pressure against the skin.

The present invention aims at the provision of a shaving unit which provides a degree of automatic adjustment of razor geometry without the disadvantage described in the preceding paragraph.

In accordance with the present invention, there is provided a shaving unit comprising a blade unit, a cap member overlying the blade unit, and a guard member which, in use, engages the skin ahead of the cutting edge of the blade unit, wherein the cap member and the guard member are movable either relative to each other or in unison and relative to the blade unit against a resilient restoring force in response to forces transmitted to the unit during shaving, to increase the shaving angle, the blade exposure, or both.

The blade unit may consist of a single blade or a pair of blades secured together with their cutting edges in spaced parallel relationship so as to act tandem upon the skin of the user.

The terms "blade exposure", "shaving angle" and "blade tangent angle" are used herein in the normal sense in which they are employed in the art, these meanings being summarized for the avoidance of doubt as follows:

"blade exposure" means the distance by which the blade edge (or edges) project forwardly of a plane tangent to the skin engaging surfaces of the guard and cap members; "shaving angle" means the acute angle between the above mentioned plane and the plane of the blade unit; "blade tangent angle" means the acute angle between a plane tangent to the cutting edge of the blade (or leading blade) and the skin engaging surface of the guard member and the plane of the blade unit.

Increasing either the blade exposure or the shaving angle (or both) increases the cutting efficiency of the razor unit in use.

In some of the embodiments of the present invention described below, the blade unit is mounted fixedly on a blade platform effectively rigid, in use, with a razor handle, and the guard member or cap member or both, are movable relative to the blade unit and platform against a spring bias which tends to minimize blade exposure. Thus, blade exposure may be increased in use by the application of shaving pressure against the action of the spring bias.

In another embodiment, the guard is fast with the blade unit and movable in use against a spring bias relative to the platform and cap to reduce blade exposure whilst increasing the shaving angle.

In other embodiments, only the guard is movable, in such a manner as to increase the blade exposure, shaving angle and blade tangent angle.

Some embodiments of the invention will now be described, by way of example, with reference to the accompanying drawings, in which.

Figure 1:
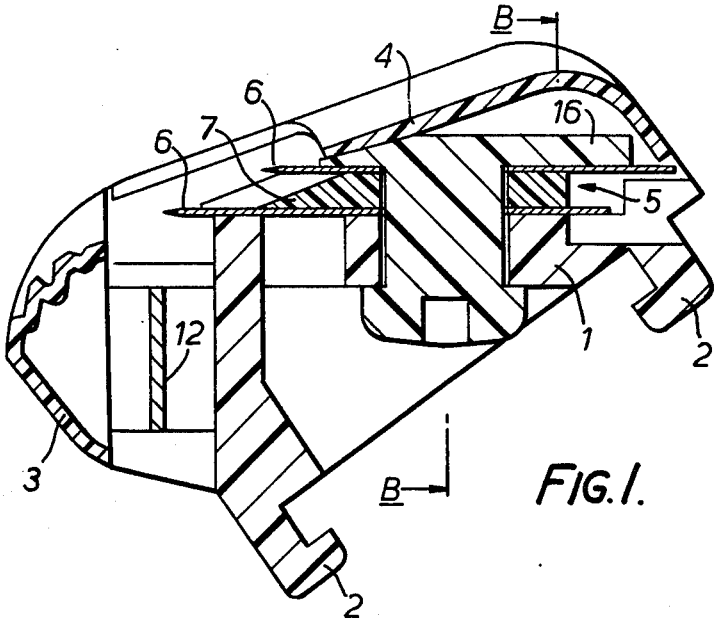
FIG. 1 is a sectional end elevation.
Figure 2:
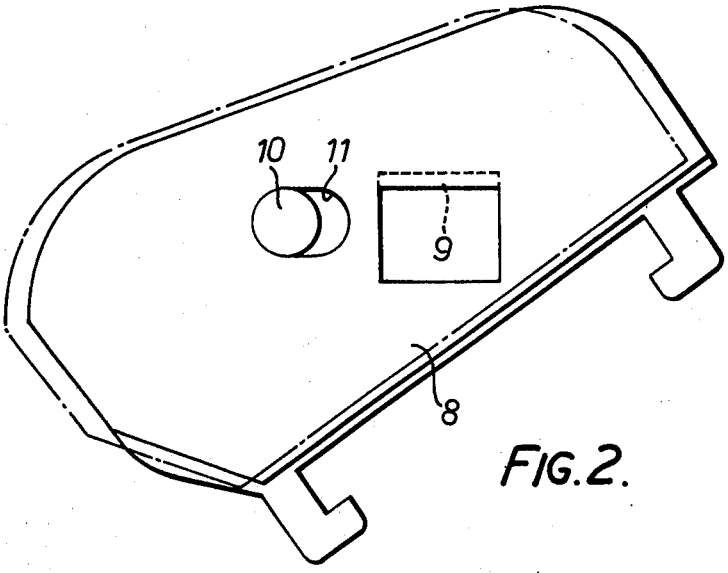
FIG. 2 is an end view.
Figure 3:
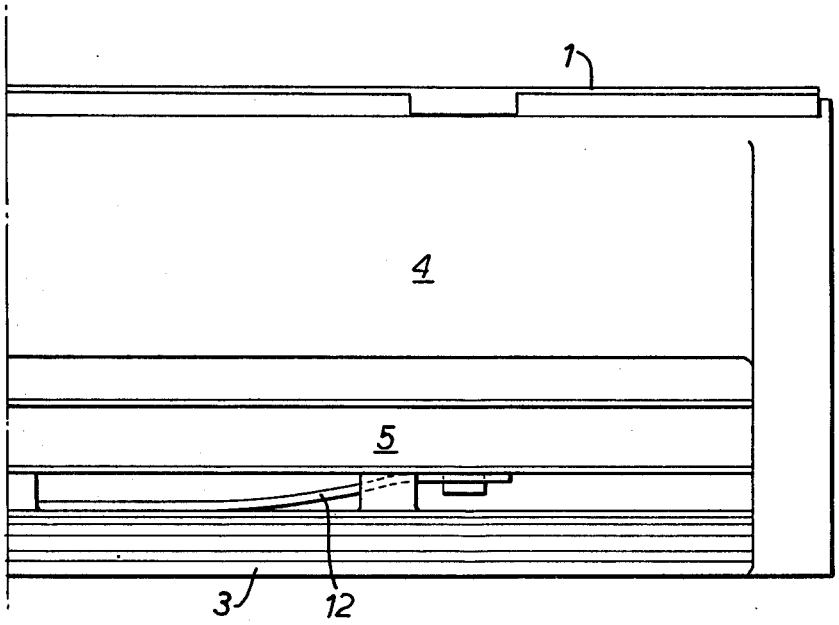
FIG. 3 is a half plan view.
Figure 4:
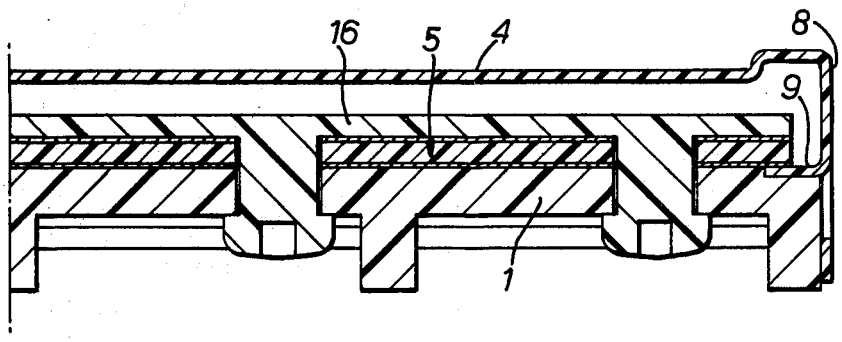
FIG. 4 is a half-section on the line BB of FIG. 1; all of a first form of unit in accordance with the invention.
Figure 5:
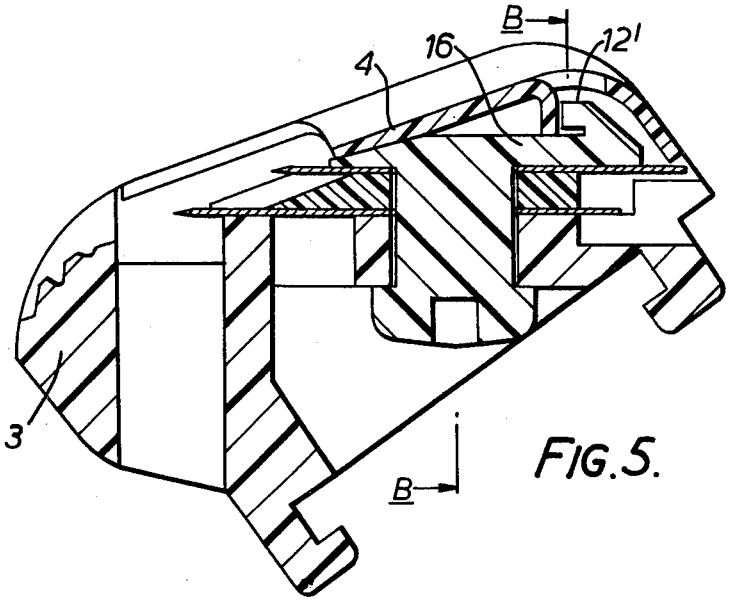
FIGS. 5 to 8 are corresponding views of a second form of unit.
Figure 6:
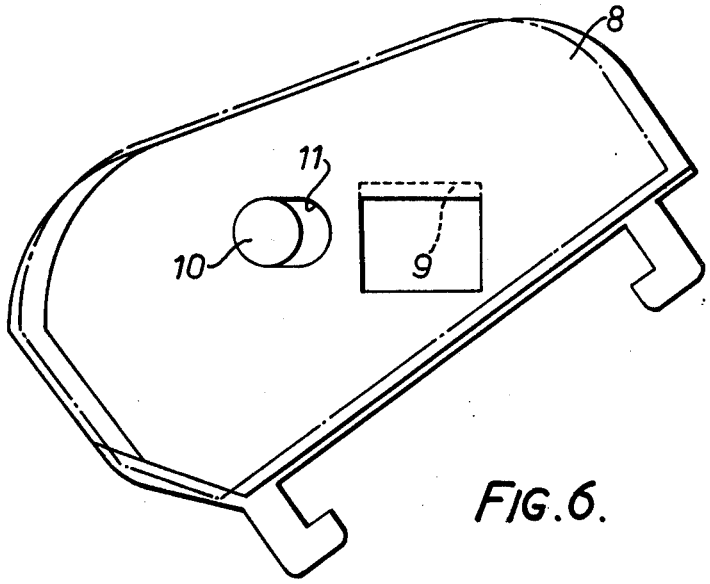
Figure 7:
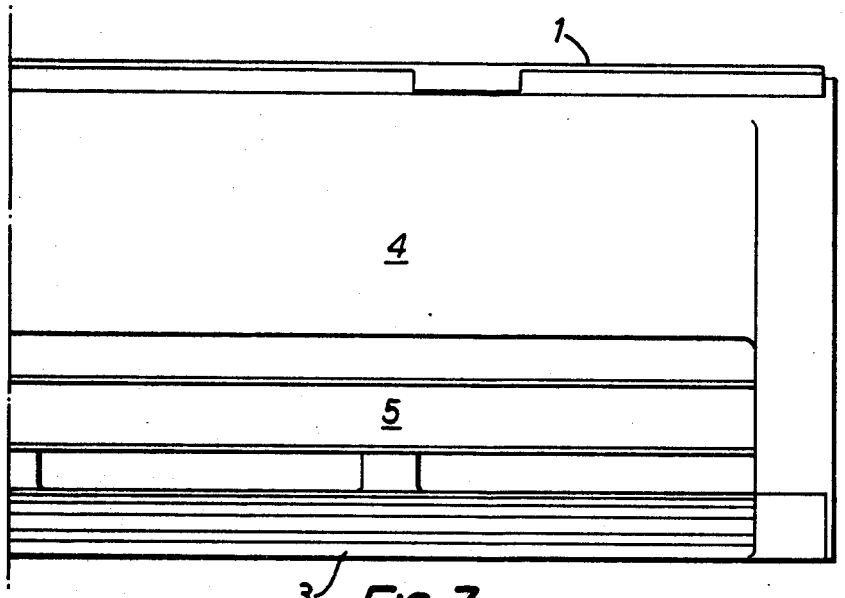
Figure 8:
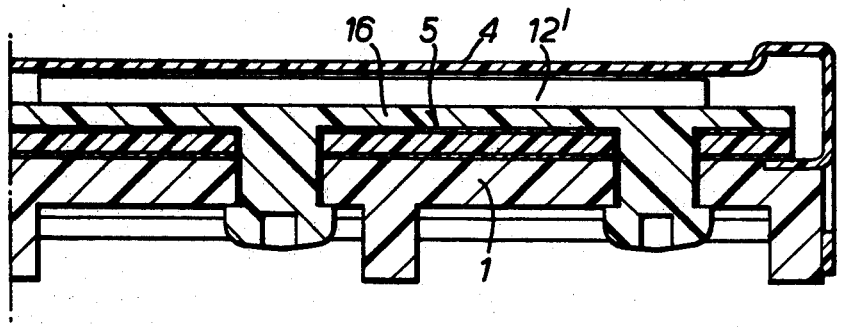
Figure 9:
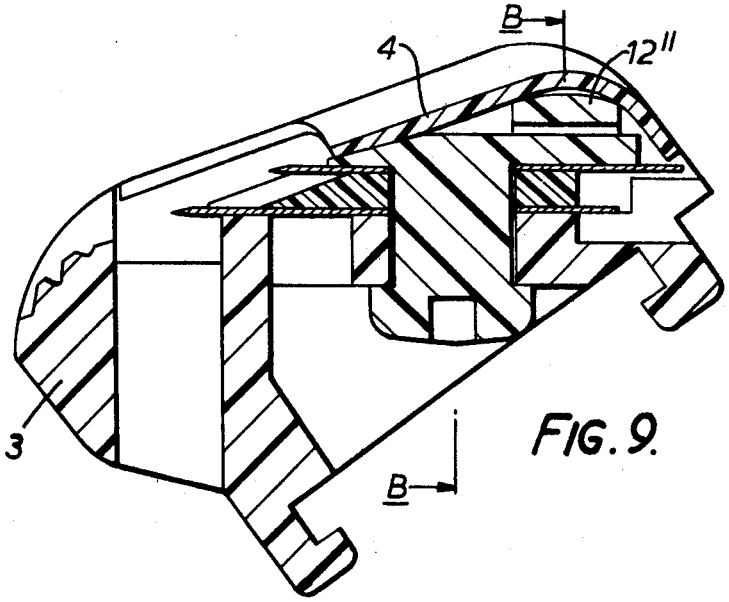
FIGS. 9 to 12 are corresponding views of a third form of unit.
Figure 10:
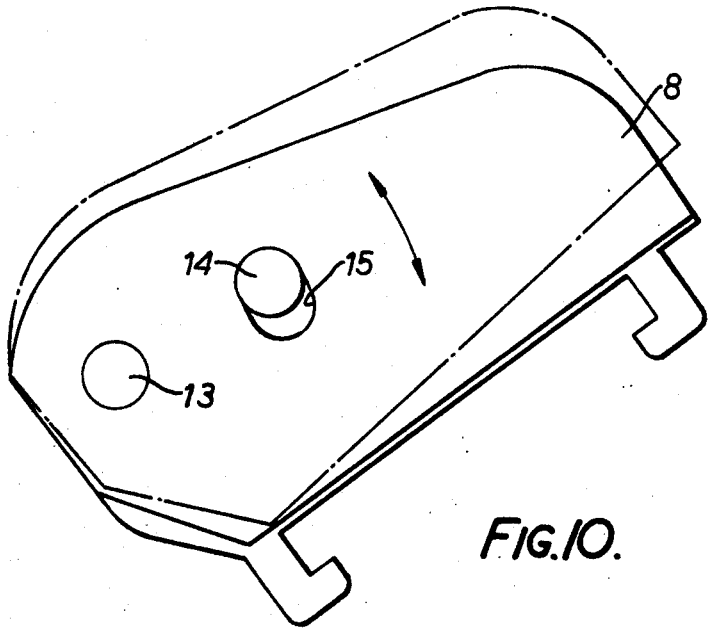
Figure 11:
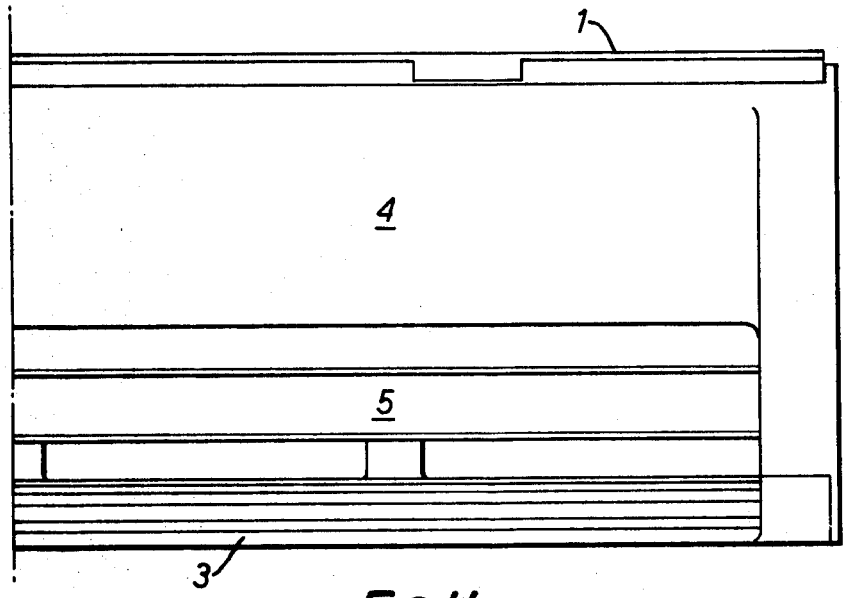

In each of the illustrating embodiments, the razor unit is of the disposable cartridge type in which the blade unit is permanently associated with the blade platform, guard and cap member, the whole unit being removed from a razor handle and discarded when the cutting edges of the blades are dulled. Each unit comprises a blade platform 1, provided in its underside with an undercut channel defined by rails 2 for releasably mounting the unit on a razor handle (not shown), a skin engaging guard 3, a cap 4 and a blade unit 5 consisting of a pair of strip-like blade members 6 secured to a spacer 7, the sharpened edges of the blade members 6 being parallel with but offset from each other to operate in tandem upon the skin of the user.

In the embodiment of FIGS. 1 to 4 the blade unit 5 is clamped to the platform 1 by the integral rivets of a clamping plate 16, and the guard 3 and cap 4 are integral with each other and with a pair of end plates 8 which extend downwardly over the ends of the platform member 1. Inturned lugs 9 on the plates 8 engage in recesses formed between the ends of the blade unit 5 and platform 1 to assist in locating and guiding the guard/cap member for sliding movement in a plane parallel with that of the blade unit, further guidance being provided by engagement of a stud 10 at each end of the platform 1 in an elongated slot 11 in the adjacent end plate 8.

A bowed leaf spring 12 operates between the forward edge of the platform 1 and the rear surface of the guard 3 to urge the guard/cap member forwardly relative to the platform and blade unit.

In use, pressure applied during shaving to the guard 3 pushes it rearwardly against the action of the spring 12 to increase the blade exposure and blade tangent angle, without any change in the shaving angle. The guard-/cap member is shown in its rearmost position and of course returns to its forward position when the shaving pressure is removed.

In the second embodiment, FIGS. 5 to 8, the guard 3 is fast with the platform and blade unit, and the cap 4 is mounted for sliding movement in directions parallel with the plane of the blade unit, against the action of a spring 12' integral with the clamping plate 16. The spring urges the cap forwardly towards a position of a minimum blade exposure. Pressure on the cap during shaving presses it back towards its rearmost, illustrated position to increase the blade exposure and reduce the shaving angle with no change in the blade tangent angle.

Figure 12:
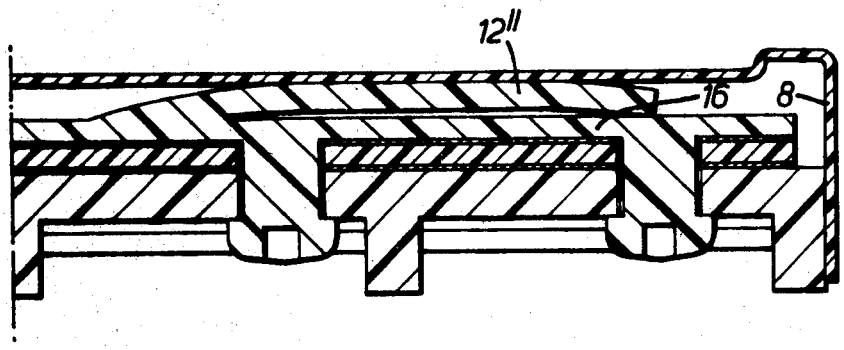
Figure 13:
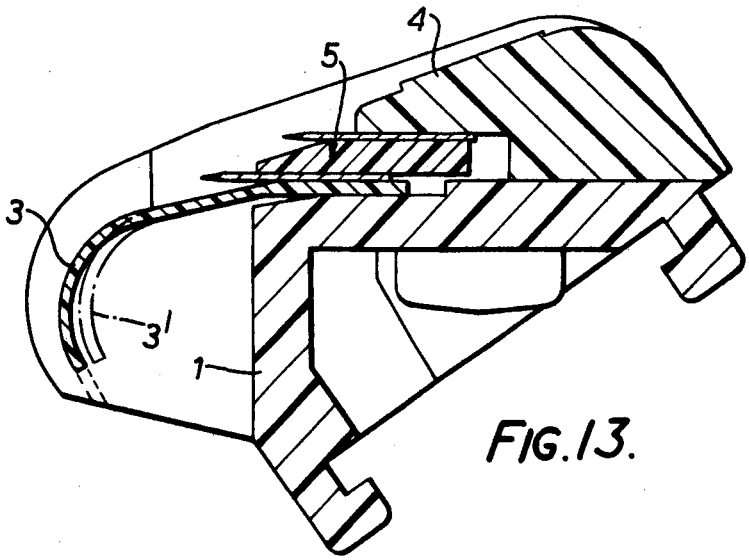
FIGS. 13 to 16 are corresponding views of a fourth form of unit.
Figure 14:
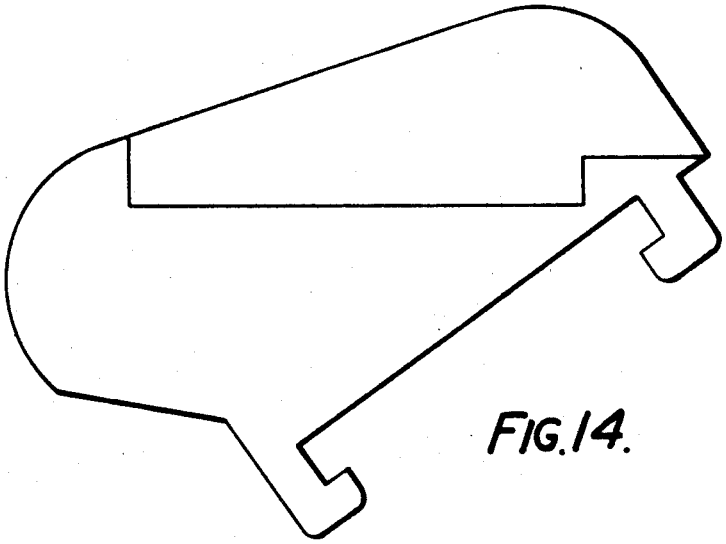
Figure 15:
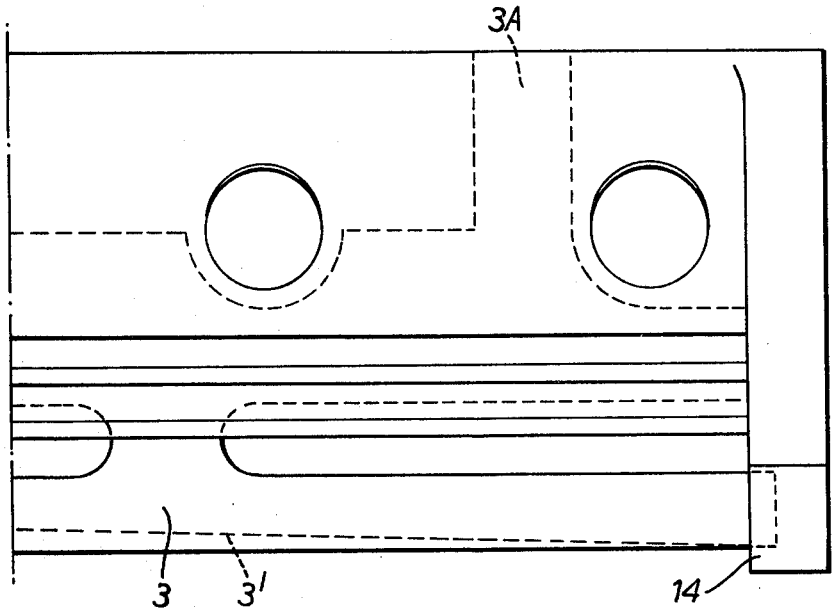
Figure 16:
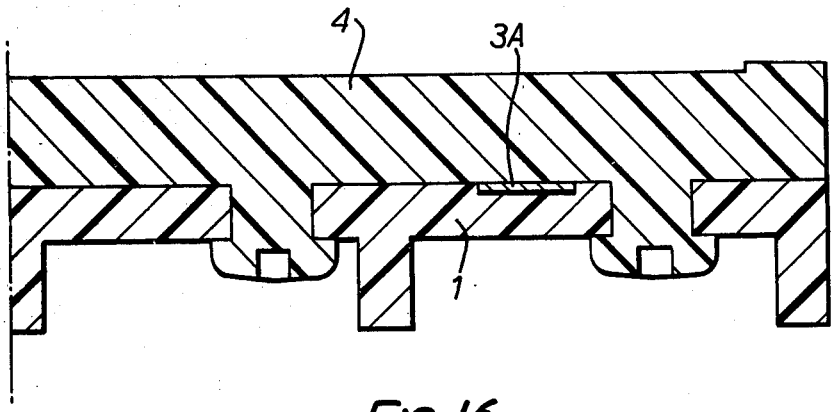

In the embodiment of FIGS. 9 to 12, again only the cap is movable relative to the guard, blade unit and platform, this time tilting about a pivot 13 arranged in line with the guard, its angular movement being limited by a pin 14 fast with the platform engaging in arcuate slots 15 in the side plates 8. A spring bias is applied by leaf springs 12" formed integrally with a top clamping plate 16 securing the blade unit 5 to the platform 1, the springs urging the cap member to pivot in an anti-clockwise direction as viewed in FIG. 12 to a position of minimum blade exposure. In use, shaving pressure on the cap urges it back towards the illustrated position of maximum blade exposure with a concomitant decrease in shaving angle but no change in blade tangent angle.

The embodiment of FIGS. 13 to 16 has a resiliently flexible metallic or plastics guard 3 to which the blade unit is secured as by spot welding or other means. The ends of the guard are fixed in forwardly projecting wings 1A of the platform member, and it has medially located, rearwardly extending projections of guide rails 3A locating in slots in the platform 1. The unit is illustrated with the guard in its normal, forward position of maximum blade exposure, but can bow rearwardly under applied shaving pressure to carry the blade unit rearwardly, relative to the platform and cap to reduce blade exposure but to increase the shaving angle. This bowing of the guard 3 is indicated by dotted lines 3' in FIGS. 13 and 15.

Figure 17:
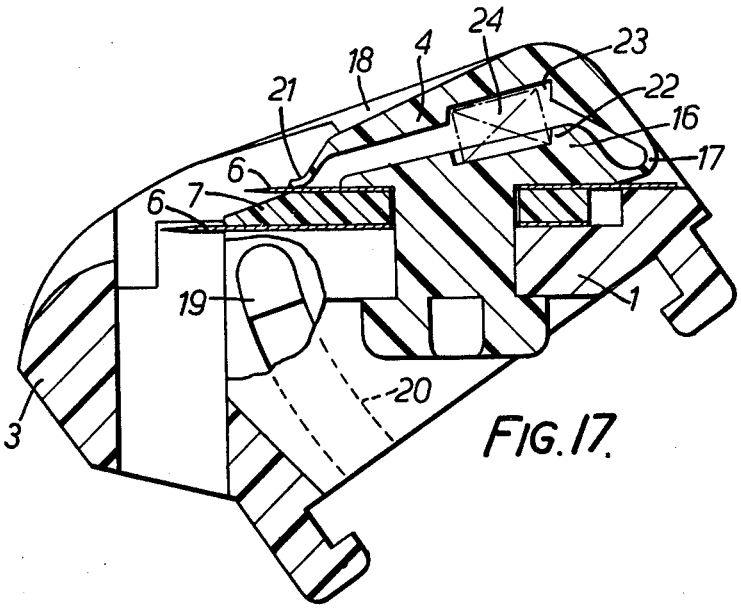
FIGS. 17, 18 and 19 are cross-sections illustrating another form of shaving unit in accordance with the invention.
Figure 18:
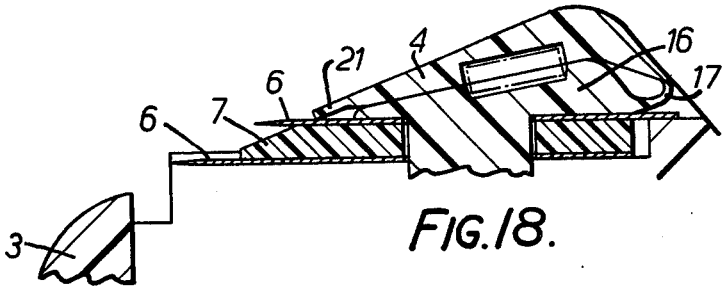

The embodiment illustrated in FIGS. 17 and 18 incorporates a plastics cap member 4 molded integrally with the clamping member 16 to which it is connected by a flexible strap or hinge portion 17, which permits the cap to pivot about an axis parallel with the cutting edges of the blade unit, at the rear of the cap. The cap has integral end wall portions 18 which embrace the platform member 1. The wall portions have integral studs 19 which run in arcuate grooves 20 in the ends of the platform member, so that the cap is constrained to move along a predetermined arcuate path relative to the blade unit.

At its leading edge, the cap 4 is formed with a resilient lip 21 which bears down on the upper blade unit. The cap and clamping members are formed in their confronting surface with respective pockets 22, 23 to receive a lead spring 24. In the assembled unit, the spring 24, acting on the underside of the cap member 4, and assisted by theresilience of the lip 21 and hinge portion 17, urges the cap member to its high position illustrated in FIG. 17, in which blade exposure is at a minimum. The pressure applied to the cap member in use tends to pivot it anti-clockwise as viewed in FIG. 17 towards the low position shown in FIG. 18, in which the lip 21 is resiliently deformed, blade exposure is increased while the shaving angle is reduced, and the blade tangent angle remains unaltered.

Figure 19:
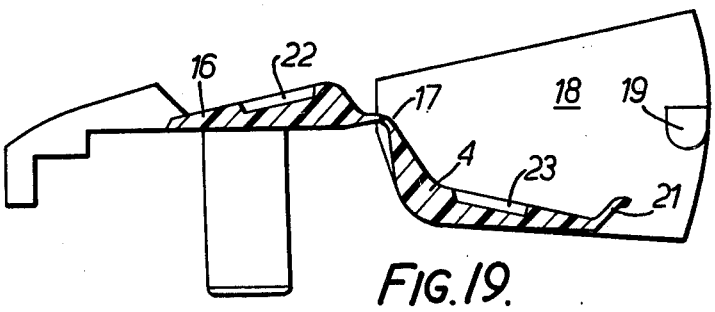

FIG. 19 illustrates a preferred and very convenient way of forming the clamping member/cap member molding, the parts being shown in this "as molded" condition. The stud on the clamping member is first passed through the blade unit and platform member and riveted. The spring 24 is placed in the pocket 22 and the cap member 4 is then brought over the clamping member, the studs 19 snapping into the grooves 20 to complete the assembly.

Figure 20:
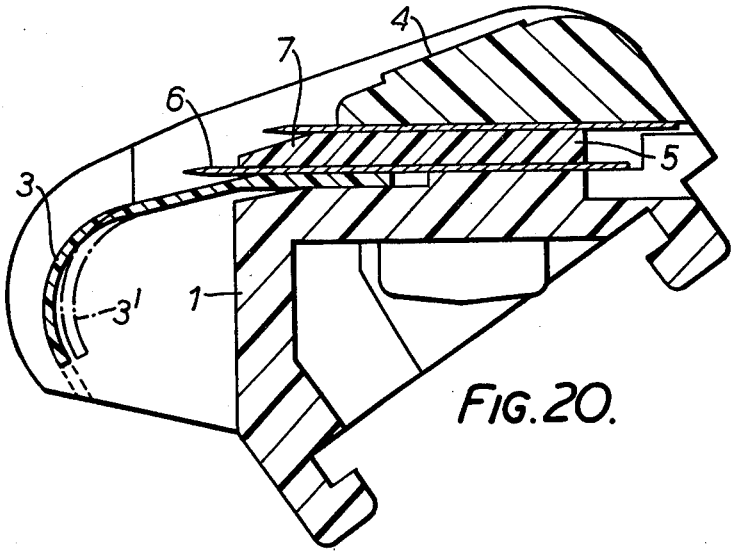
FIG. 20 is a view corresponding to FIG. 13 showing a modification.

The embodiment shown in FIG. 20 is generally similar to that of FIGS. 13 to 16 except that the blade unit is fixed to the platform and cap, and therefore does not partake in the rearward increment of the guard 3 which takes place during shaving whereby to increase the blade exposure, shaving angle and blade tangent angle.

Figure 21:
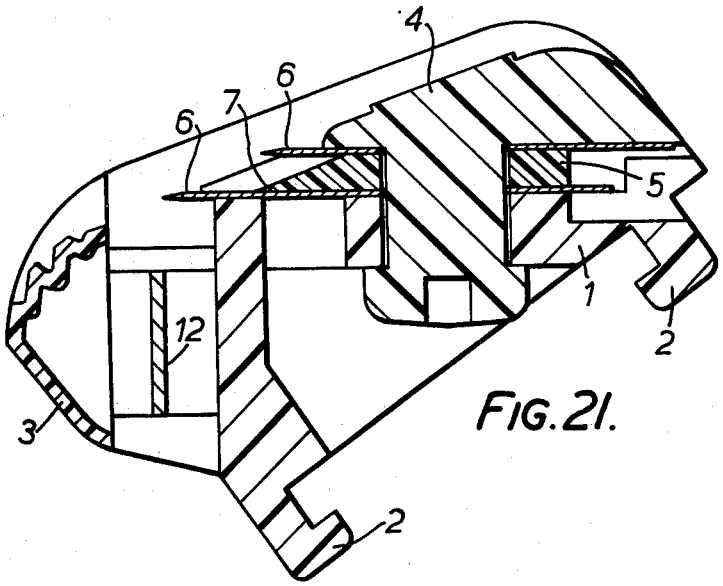
FIGS. 21 and 22 are views corresponding to FIGS. 1 and 3 illustrating another modification.
Figure 22:
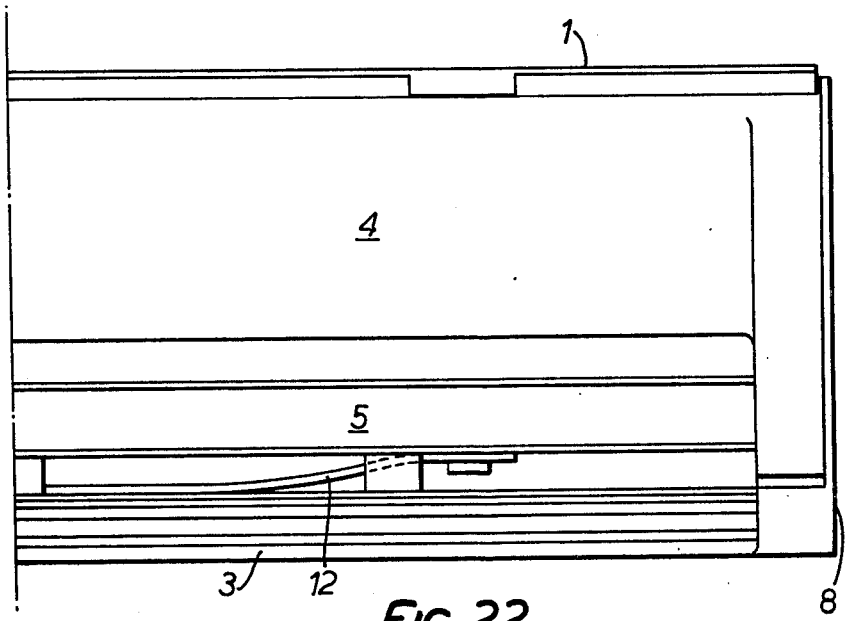

Finally, the embodiment shown in FIGS. 21 and 22 is generally similar to that of FIGS. 1 to 4, except that the cap 4 is no longer integral with the guard 3 and plates 8, but is fast with the blade unit and platform. The plates 8 and guard 3 are guided, as in the first embodiment for sliding movement in planes parallel with the blade unit in response to shaving pressure applied to the gaurd, rearward movement of the guard again resulting in an increase of the blade exposure, shaving angle and blade tangent angle.

We claim:

1. A shaving unit comprising cap means, first platform means, said cap means being permanently joined to said first platform means, said first platform means having a connector portion for connection of said unit to a razor handle, blade means, and guard means, said guard means comprising a guard portion for engaging the skin ahead of a cutting edge of said blade means and a second platform portion, said guard portion being an extension of said second platform portion, said blade means and said guard portion being permanently joined and disposed between said cap means and said first platform means, said blade means and said second platform portion being slidably movable in unison relative to and between said cap means and said first platform means against a resilient restoring force in response to forces transmitted to said unit during shaving.

2. A shaving unit according to claim 1, wherein said guard means guard portion is resiliently flexible in a plane parallel with that of said blade means and said guard means second platform portion is fixed to said blade means for sliding movement in a plane parallel to the plane of said blade means so that said blade means and said guard means are caused to slidingly move rearwardly relative to said cap means and said platform means when said guard means is deflected rearwardly.

3. A shaving unit according to claim 1, wherein said guard means is resiliently flexible in a plane parallel with that of said guard portion of said blade means, so as to be deflected in use, relative to said blade means and said cap means.

* * * * *